US005159907A

United States Patent [19]

Budde

[11] Patent Number: 5,159,907

[45] Date of Patent: Nov. 3, 1992

[54] HYDRAULIC VALVE LIFTER

[75] Inventor: Volker Budde, Grosskarlbach, Fed. Rep. of Germany

[73] Assignee: Firma Carl Freudenberg, Weinheim/Bergstrasse, Fed. Rep. of Germany

[21] Appl. No.: 803,270

[22] Filed: Dec. 3, 1991

[30] Foreign Application Priority Data

Mar. 6, 1991 [DE] Fed. Rep. of Germany ..... 4107041

[51] Int. Cl.[5] ..... F01L 1/24

[52] U.S. Cl. ..... 123/90.55; 123/90.14

[58] Field of Search ..... 123/90.19, 90.48, 90.49, 123/90.52, 90.55, 90.58; 74/569

[56] References Cited

U.S. PATENT DOCUMENTS 4,397,271 8/1983 Gardner ..... 123/90.55
4,662,325 5/1987 Okabe et al. ..... 123/90.55
4,779,583 10/1988 Laffter et al. ..... 123/90.55
4,977,867 12/1990 Rhoads ..... 123/90.55

FOREIGN PATENT DOCUMENTS 0155309 12/1979 Japan ..... 123/90.55

*Primary Examiner*—E. Rollins Cross
*Assistant Examiner*—Weilun Lo
*Attorney, Agent, or Firm*—Sprung, Horn, Kramer & Woods

[57] ABSTRACT

A hydraulic valve lifter for the mechanism that activates a valve in an internal combustion engine. It comprises two hollow cylinders sealed off from each other with caps over their opposite ends and engaging each other axially by way of a compression spring. The cylinders engage each other not only by way of the compression spring but also by way of a back-up spring opposing the compression spring and made of a shape memory alloy with a compression resistance that is lower, once the As temperature has been attained, than the compression resistance of the compression spring.

5 Claims, 2 Drawing Sheets

HYDRAULIC VALVE LIFTER

BACKGROUND OF THE INVENTION

The present invention concerns a hydraulic clearance compensating element for the intake and exhaust valve drives in an internal combustion engine. Such an element, or so-called "valve lifter", comprises two hollow cylinders mobilely sealed off from each other with caps over their opposite ends which engage each other axially by way of a compression spring.

A hydraulic valve lifter of this type is known, for example, from the German Patent No. 3,616,858. It is employed between the camshaft and the valves of an internal combustion engine to automatically adjust valve strokes. It is accordingly no longer necessary to adjust the valves during regular maintenance.

The known valve lifter has a piston that travels back and forth in a cylinder in the same direction in which the valve is actuated. The piston rests on a compression spring on the bottom of the cylinder. When there is no load on the valve lifter, the piston will accordingly travel in and out of the cylinder axially. Lubricating oil is drawn out of a reservoir through a constricted aperture and stored inside a pressurized compartment in the piston-and-cylinder mechanism. Since the constricted aperture is very small, the amount of oil stored in the piston-and-cylinder mechanism is not noticeably diminished during the brief interval that occurs while the valve is normally actuated by one of the cams on the camshaft. The forces that actuate the valve can be transmitted without any problem.

Sometimes, however, one of the cams will come to rest against a valve lifter while the engine is temporarily switched off, axially compressing it against the force of its interior compression spring. The oil in the pressurized compartment will increasingly leak back into the reservoir. The piston-and-cylinder mechanism can no longer take oil in rapidly enough, as the cam continues to rotate, to operate reliably at low temperatures.

For an internal combustion engine to function properly, the compression spring must reliably force the piston and cylinder apart rapidly enough even in cold weather to adjust the valve strokes. The spring must, of course, first force the oil in the reservoir into the piston-and-cylinder mechanism rapidly enough. Since oil becomes highly viscous at low temperatures, the spring must be very strong, and consequently those springs employed at the state of the art are very large. The unavoidable consequence is an undesirably strong force separating the piston from the cylinder at normal and especially at high temperatures, which can also contribute to undesirable wear and tear on the valve lifter.

A compression spring made of a shape memory metal alloy is known from "Legierung mit Formgedächtnis", *Kontakt und Studium,* Vol. 259, Expert Verlag, Ehningen. Depending on the composition of the alloy, the spring will support almost no load at a low temperature but will commence to support more and more load at a higher critical temperature or so-called "As temperature".

SUMMARY OF THE INVENTION

A principal object of the present invention is to improve a hydraulic valve lifter of the aforesaid type to the extent that immediate filling of the piston-and-cylinder mechanism from the reservoir will be ensured even at low temperatures along with low-resilience engagement between the two cylinders at normal operating temperatures.

This object, as well as other objects which will become apparent from the discussion that follows, are achieved, in accordance with the present invention, providing a hydraulic valve lifter with a "back-up spring" opposing the compression spring and made of a shape memory metal alloy with a compression resistance that is lower, once the As temperature has been attained, than the compression resistance of the compression spring. At lower temperatures, accordingly, the back-up spring will lose resilience, and the only effective force will be the compression spring's resilience, strong enough to ensure that, in spite of the high viscosity of the lubricating oil in the valve lifter, the piston-and-cylinder mechanism will rapidly fill with oil as the cam rotates on the camshaft. This approach ensures that the associated valve will be correctly activated from the very first instant the internal combustion engine is in operation. Once the valve-actuation mechanism, including the valve lifter and the oil accommodated therein, has warmed up from a cold start to a high enough operating temperature, the back-up spring will recover its resilience. Since it opposes the force of the compression spring, the overall resilience will be decreased to a level that ensures both a high reliability and minimum wear and tear.

Both the compression spring and the back-up spring are preferably helical springs. Helical springs are particularly cost-effective to manufacture and to install.

It has been demonstrated as practical for the back-up spring to be made of a shape memory alloy with an As temperature ranging from $-15°$ to $+5°$ C. and especially in the vicinity of the freezing point of water. It is within this range in particular that the viscosity of conventional oils becomes relatively high. Obviously, a shape memory alloy with a completely different As temperature can be employed to match the viscosity of a particular oil.

The compression resistance of the back-up spring should be 30 to 70% of that of the compression spring. Such a feature will be particularly useful in contemporary automotive engineering in its attempts to prevent malfunction throughout the life of the vehicle.

The valve lifter in accordance with the invention will consistently accelerate the filling of the piston-and-cylinder mechanism with oil at no matter what temperature to an extent that the internal combustion engine will always operate reliably. One decisive advantage is that the embodiment in accordance with the invention has the same shape and essential components as the known embodiments. This feature makes it possible to manufacture and install the valve lifter in accordance with the invention on an industrial scale. The valve lifters in accordance with the invention can be permanently full of oil and hermetically sealed or they can be replenished with oil from the engine's lubrication system.

The preferred embodiments of the invention will now be described with reference to the accompanying drawing.

DESCRIPTION OF THE PREFERRED EMBODIMENTS

Figure 1:
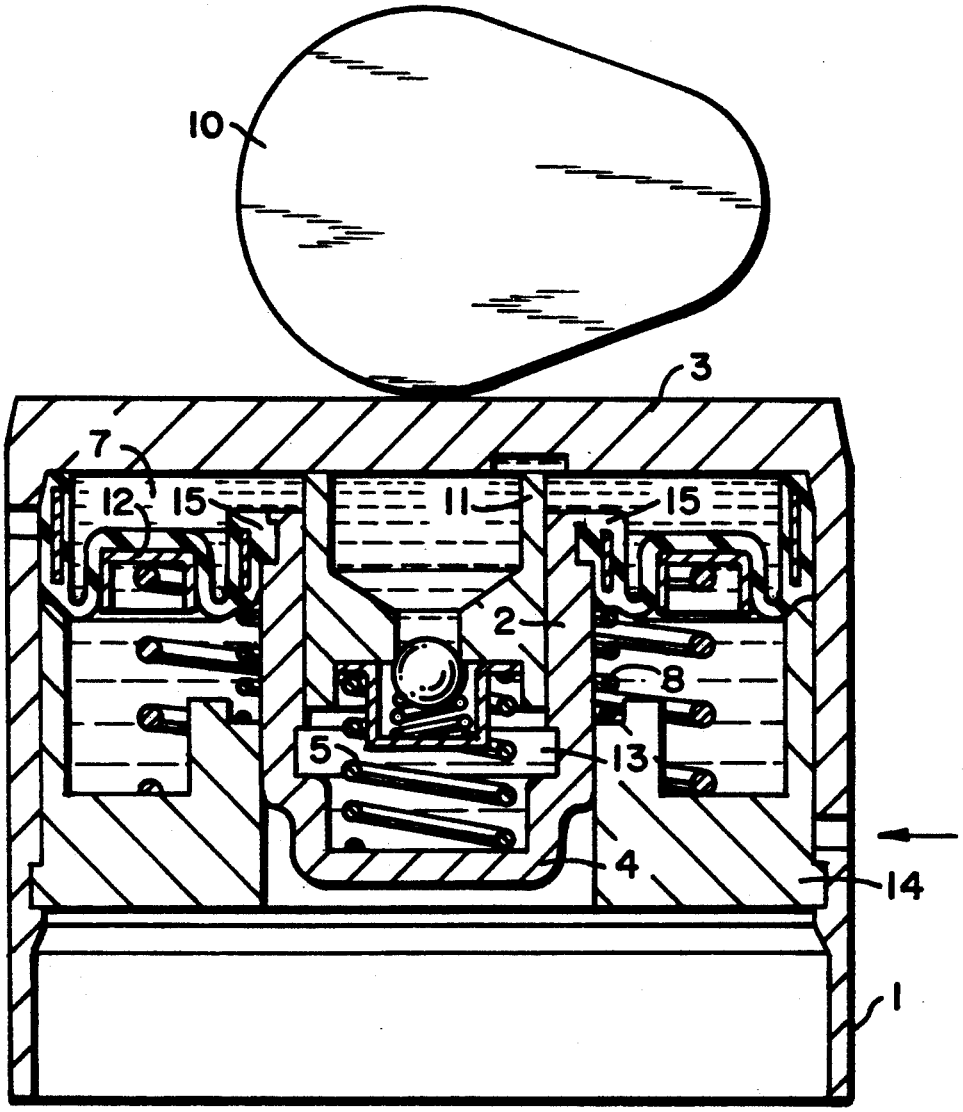
FIG. 1 is a longitudinal section through a valve lifter in accordance with a first preferred embodiment of the present invention.

The valve lifter illustrated in FIG. 1 is a closed system permanently full of oil.

Figure 2:
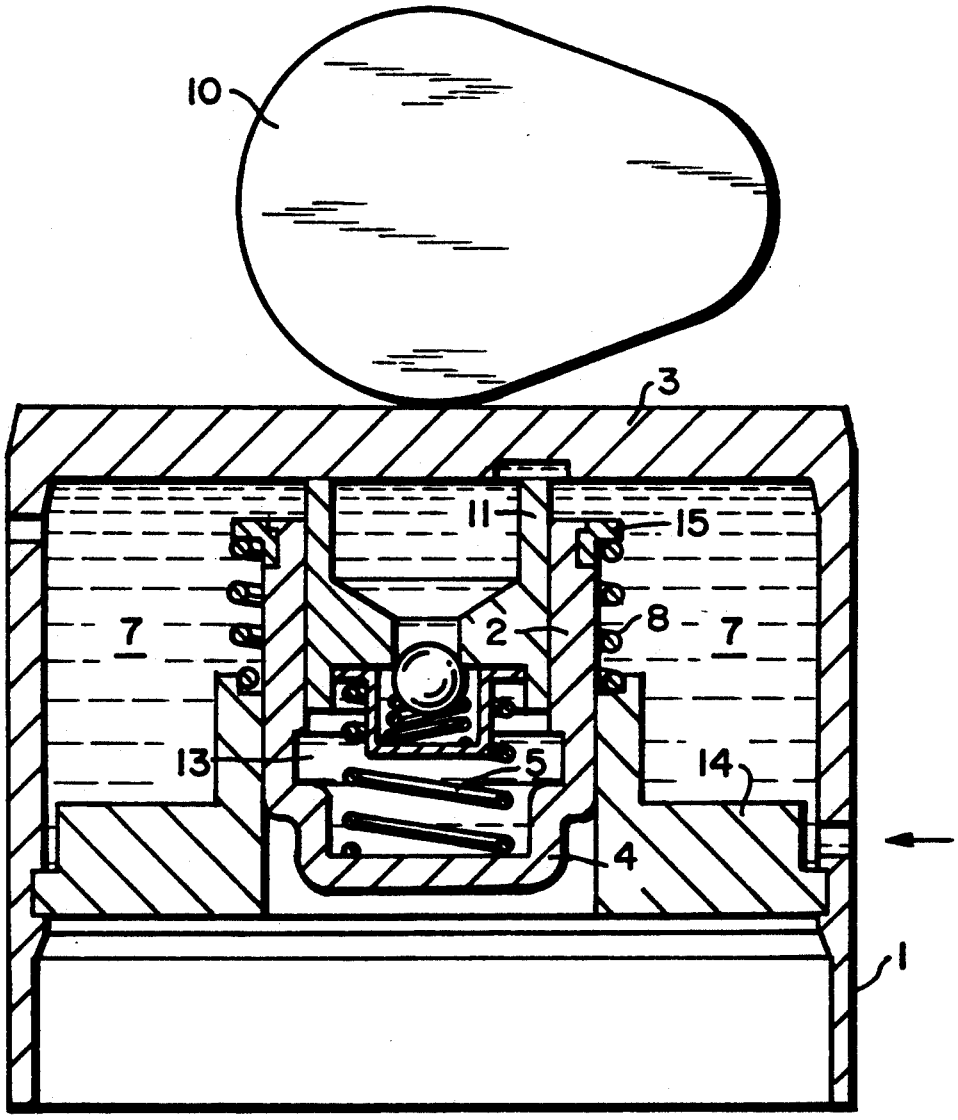
FIG. 2 is a longitudinal section through a valve lifter in accordance with a second preferred embodiment of the present invention.

The valve lifter illustrated in the FIG. 2 communicates with, and receives oil from the lubricating system that circulates oil throughout the internal combustion engine.

Each embodiment of the valve lifter in accordance with the invention comprises two hollow cylinders 1 and 2 mobilely sealed off from each other with caps 3 and 4 over their opposite ends and engaging each other axially by way of a compression spring 5. Cylinder 2 is mounted on a piston 11 that is coaxial with cylinder 1 and rests against its cap 3.

Compression spring 5 is accommodated between piston 11 and the bottom 4 of cylinder 2 and forces the piston axially out of cylinder 2. This procedure completely fills the compartment demarcated by the piston and cylinder with oil. This compartment now communicates with a reservoir 7 of extra oil only through a constricted gap. Reservoir 7 can communicate with and receive fresh oil from the lubrication system that circulates oil throughout the internal combustion engine as illustrated in FIG. 2 or be hermetically sealed by a cuffed diaphragm 12 as illustrated in FIG. 1. The latter approach will ensure reliable function of the valve lifter independent of the pressure prevailing in the lubricating system.

Cylinder 2 slides back and forth in a guide 14. Accommodated between guide 14 and a collar 15 rigidly secured to piston 11 is a back-up spring 8 of shape memory metal alloy. When the temperature drops below a certain range, back-up spring 8 loses resilience, regaining it when it warms up to its As temperature again. This spring is also a compression spring, although it opposes the force of compression spring 5. When, accordingly, back-up spring 8 completely loses resilience, the system's total resilience will be that of compression spring 5 alone. Thus, it is only the difference between the compression resistances of the two springs that is on the whole available.

The valve lifter in accordance with the invention is normally completely full of oil. The camshaft rests against the upper surface of cap 3. Cam 10 is not displacing the valve during the phase represented by the figures. The operation of the valve lifter in accordance with the invention will now be described.

The camshaft rotates when the engine is operating. Cam 10 revolves against the upper surface of the valve lifter and briefly forces it down parallel with the midline of the figures. During this brief interval, the oil confined between cylinder 2 and piston 11 cannot penetrate the constricted gap between them, and cylinder 2 rests almost rigidly against piston 11 and accordingly against the cap 3 over cylinder 1. The force exerted by cam 10 is accordingly transmitted almost undiminished to the valve stem (not shown), opening the valve.

As the camshaft continues to rotate, cam 10 will release cylinder 1, valve lifter will move up as a whole, and the valve stem will return to its disengaged position. Any oil lost in the vicinity of the pressurized compartment between piston 11 and cylinder 2 will be replenished from reservoir 7 due to the suction generated by compression spring 5.

If the engine is switched off while cam 10 is in the process of pressing against the cap 3 on cylinder 1, the valve's closure spring (not shown), which is substantially stronger than compression spring 5, will gradually force cylinder 2 up in relation to cylinder 1 and pump any residual oil in a highly pressurized compartment 13 into reservoir 7. At ambient and higher temperatures, back-up spring 8 will oppose compression spring 5 and diminish the overall force separating cylinder 2 and piston 11 and accordingly also reduce the friction between rotating cam 10 and the cap 3 on cylinder 1. Since the oil is very fluid at the temperature range in question, only a little resilience will be necessary.

On the other hand, at lower temperatures and especially when starting the internal combustion engine cold, the oil will be viscous, and substantial spring resilience will be needed to force cylinder 2 and piston 11 apart axially and to draw oil through the one-way ball valve and into the compartment they demarcate. When the temperature is sufficiently low, back-up spring 8 will have no resilience, and the total load resistance of compression spring 5 will be available for axially separating cylinder 2 from piston 11. A rapid enough separation of the piston from the cylinder will accordingly be ensured, even under poor conditions.

There has thus been shown and described a novel valve lifter that fulfills all the objects and advantages sought therefor. Many changes, modifications, variations, and other uses and applications of the subject invention will, however, become apparent to those skilled in the art after considering this specification and the accompanying drawings, which disclose the preferred embodiments thereof. All such changes, modifications, variations, and other uses and applications that do not depart from the spirit and scope of the invention are deemed to be covered by the invention, which is to be limited only by the claims that follow.

What is claimed is:

1. In a hydraulic valve lifter for an intake or exhaust valve in an internal combustion engine, said lifter comprising two hollow cylinders sealed off from each other with caps over their opposite ends and engaging each other axially by way of a compression spring, the improvement wherein said lifter further includes a back-up spring arranged in an opposing relationship to the compression spring and made of a shape memory metal alloy with a compression resistance that is lower, once an As temperature has been attained, than the compression resistance of the compression spring.

2. The valve lifter defined in claim 1, wherein both the compression spring and the back-up spring are helical springs.

3. The valve lifter defined in claim 1, wherein the back-up spring is made of the shape memory alloy with the As temperature ranging from −15° to +5° C.

4. The valve lifter defined in claim 1, wherein the back-up spring is made of the shape memory alloy with the As temperature in the vicinity of the freezing point of water.

5. The valve lifter defined in claim 1, wherein the compression resistance of the back-up spring is 30 to 70% of that of the compression spring.

* * * * *